US012616889B2

(12) United States Patent
Gao

(10) Patent No.: US 12,616,889 B2
(45) Date of Patent: May 5, 2026

(54) COUNTERWEIGHT BASE FOR PUNCHING BAG

(71) Applicant: LinYi AiBeiJian Sports Goods Co., Ltd., Linyi (CN)

(72) Inventor: Huijin Gao, Linyi (CN)

(73) Assignee: LINYI AIBEIJIAN SPORTS GOODS CO., LTD., Linyi (CN)

( * ) Notice: Subject to any disclaimer, the term of this patent is extended or adjusted under 35 U.S.C. 154(b) by 91 days.

(21) Appl. No.: 18/809,273

(22) Filed: Aug. 19, 2024

(65) Prior Publication Data

US 2026/0034425 A1 Feb. 5, 2026

(30) Foreign Application Priority Data

Jul. 31, 2024 (CN) ..... 202421826325.0

(51) Int. Cl.
*A63B 69/22* (2006.01)

(52) U.S. Cl.
CPC ..... *A63B 69/22* (2022.08); *A63B 2225/055* (2013.01); *A63B 2244/102* (2013.01)

(58) Field of Classification Search
CPC ..... A63B 69/20–325; A63B 2071/026; A63B 2210/50; A63B 2225/05–055; A63B 2244/10–102
USPC ..... D21/787
See application file for complete search history.

(56) References Cited

U.S. PATENT DOCUMENTS

| | | | | | |
|---|---|---|---|---|---|
| 6,027,435 | A * | 2/2000 | Nadorf | A63B 69/224 | 482/146 |
| 7,704,194 | B1 * | 4/2010 | Chen | A63B 69/224 | 482/90 |
| 10,065,098 | B2 * | 9/2018 | Almeras | A63B 69/305 | |
| D899,544 | S * | 10/2020 | Li | D21/787 | |
| D912,753 | S * | 3/2021 | Zheng | D21/787 | |
| D926,903 | S * | 8/2021 | Zheng | D21/787 | |
| 11,253,765 | B1 * | 2/2022 | Huang | A63B 69/32 | |
| 12,251,612 | B2 * | 3/2025 | Hoang | A63B 69/224 | |
| 12,330,037 | B2 * | 6/2025 | Gao | A63B 69/224 | |
| 2014/0128226 | A1 * | 5/2014 | Chang | A63B 69/22 | 482/83 |

* cited by examiner

*Primary Examiner* — Loan B Jimenez
*Assistant Examiner* — Kathleen M Fisk
(74) *Attorney, Agent, or Firm* — MATTHIAS SCHOLL P.C.; Matthias Scholl

(57) ABSTRACT

A counterweight base for a punching bag, including a counterweight body, a conical connector, and a plurality of suction discs. The counterweight body includes a platform and an accommodating cavity. The upper part of the counterweight body protrudes to form a circular truncated cone, and the platform is disposed in the center of the top surface of the circular truncated cone. The accommodating cavity is disposed in the center of the bottom part of the counterweight body. The accommodating cavity includes a bottom opening, and is in the shape of a conical column. The conical connector is matched with the accommodating cavity in size and shape, and includes a flange base. A step is disposed in the bottom opening of the accommodating cavity. In a storage state of the counterweight base, the conical connector is disposed in the accommodating cavity, and the flange base is supported by the step.

6 Claims, 5 Drawing Sheets

COUNTERWEIGHT BASE FOR PUNCHING BAG

CROSS-REFERENCE TO RELATED APPLICATIONS

Pursuant to 35 U.S.C. § 119 and the Paris Convention Treaty, this application claims foreign priority to Chinese Patent Application No. 202421826325.0 filed Jul. 31, 2024, the contents of which, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to the field of boxing devices, and more particularly to a counterweight base for a punching bag.

Vertical punching bags for boxing usually include an upper practicing body and a lower counterweight base. The lower counterweight base, together with a variety of connectors attached to it, is larger than the upper practicing body in terms of diameter, resulting in a large overall packaging size, even exceeding the standard volume limitations, thereby increasing the logistics and warehousing costs.

SUMMARY

To solve the aforesaid problems, the disclosure provides a counterweight base for a punching bag with a compact size, so as to reduce the overall packaging volume, the logistics and distribution and warehousing costs.

To achieve the above objective, the disclosure provides a counterweight base for a punching bag comprising a counterweight body, a conical connector, and a plurality of suction discs. The counterweight body is a one-piece barrel-shaped container in the form of a flat cylinder, and comprises a platform and an accommodating cavity; an upper part of the counterweight body protrudes to form a circular truncated cone, and the platform is disposed in a center of a top surface of the circular truncated cone; the accommodating cavity is disposed in a center of a bottom part of the counterweight body; the accommodating cavity comprises a bottom opening that tapers inward, and is in the shape of a conical column; the conical connector is matched with the accommodating cavity in size and shape, and comprises a flange base; a step is disposed in the bottom opening of the accommodating cavity; in a storage state of the counterweight base, the conical connector is disposed in the accommodating cavity, and the flange base is supported by the step; a plurality of first inbuilt nuts are disposed on the platform; the flange base comprises a plurality of mounting holes; in a use state of the counterweight base, the conical connector is fixed on the platform through the plurality of first inbuilt nuts passing through the plurality of mounting holes; and a plurality of second inbuilt nuts are disposed on a bottom end face of the counterweight base, and the plurality of suction discs are attached to the counterweight base through the plurality of second inbuilt nuts, respectively.

In a class of this embodiment, a plurality of radial grooves are disposed on an inner side wall of the counterweight body and the bottom end face of the counterweight body; a plurality of strengthening ribs protrude from an outer surface of the conical connector; and the plurality of strengthening ribs are embedded in the radial grooves on the inner side wall of the counterweight body, respectively.

In a class of this embodiment, a plurality of third inbuilt nuts are disposed on the step; a baffle plate is fixed on the step through the plurality of third inbuilt nuts; the suction discs are further disposed on the baffle plate; and a thickness of the baffle plate is equal to a depth of the step.

In a class of this embodiment, a conical surface of the counterweight body below the platform is a decorative surface; and the decorative surface comprises a plurality of evenly distributed patterns with alternating uplifts and sags.

In a class of this embodiment, the counterweight body is an integrated structure formed by plastic injection molding.

In a class of this embodiment, the upper part of the counterweight body comprises a top opening and a cover.

The following advantages are associated with the counterweight base for a punching bag of the disclosure.

1. The counterweight base adopts an embedded storage structure, and the conical connector is embedded into the bottom of the counterweight base, which effectively reduces the space occupation of the conical connector during transportation, reduces the overall packaging volume, effectively reduces the cost of logistics and distribution and warehousing, and at the same time, makes the packaging process more convenient, and more simple and efficient in the logistics turnover and transportation and material retrieval and assembly.

2. The counterweight base adopts a container structure, has a light weight, thus reducing the logistics and transportation costs. To further improve the stability of the counterweight base, a filler which can be locally sourced is injected through the top opening. The counterweight base is easy to assemble. The sand and gravel are filled in the accommodating cavity, and the accommodating cavity is sealed by the baffle plate, so as to make the utilization of the counterweight space more thorough.

Figure 1:
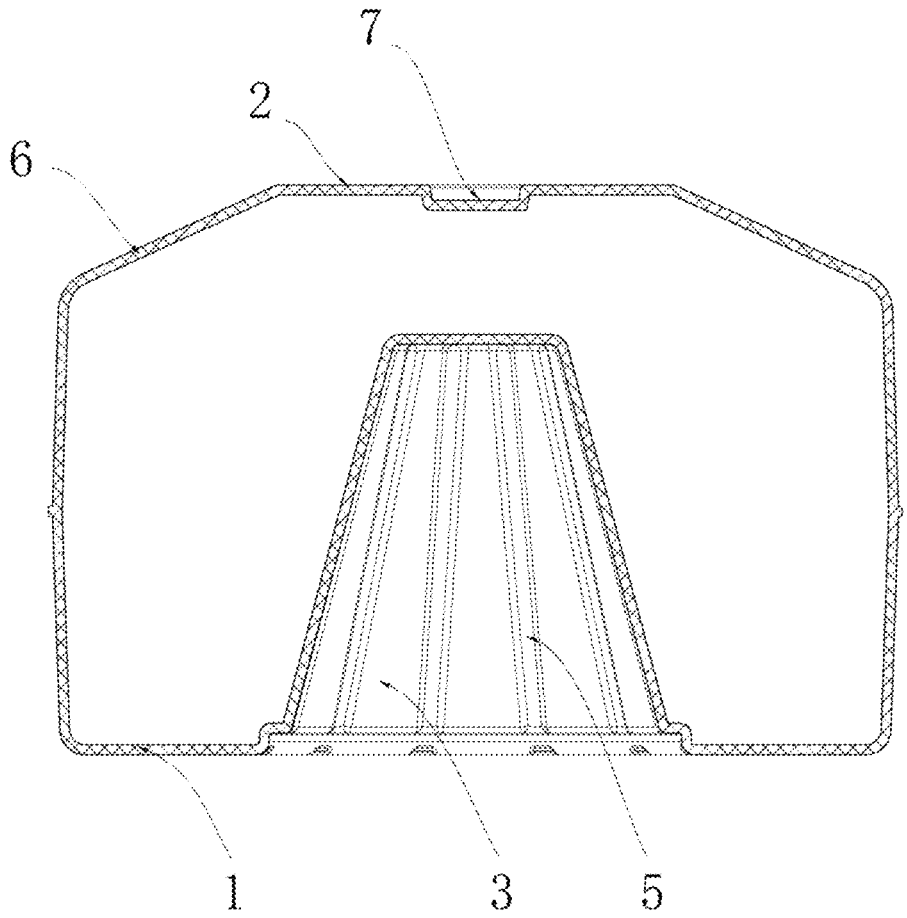
FIG. 1 is a sectional view of a counterweight base for a punching bag according to one embodiment of the disclosure.

In the drawings, the following reference numbers are used: 1. Counterweight body; 2. Platform; 3. Accommodating cavity; 4. Inbuilt nut; 5. Groove; 6. Decorative surface; 7. Top opening; 8. Conical connector; 9. Mounting hole; 10. Strengthening rib; 11. Socket; 12. Baffle plate; 13. Suction disc; 14. Connecting rod; 15. Practicing body.

DETAILED DESCRIPTION

To further illustrate the disclosure, embodiments detailing a counterweight base for a punching bag are described below. It should be noted that the following embodiments are intended to describe and not to limit the disclosure.

Figure 2:
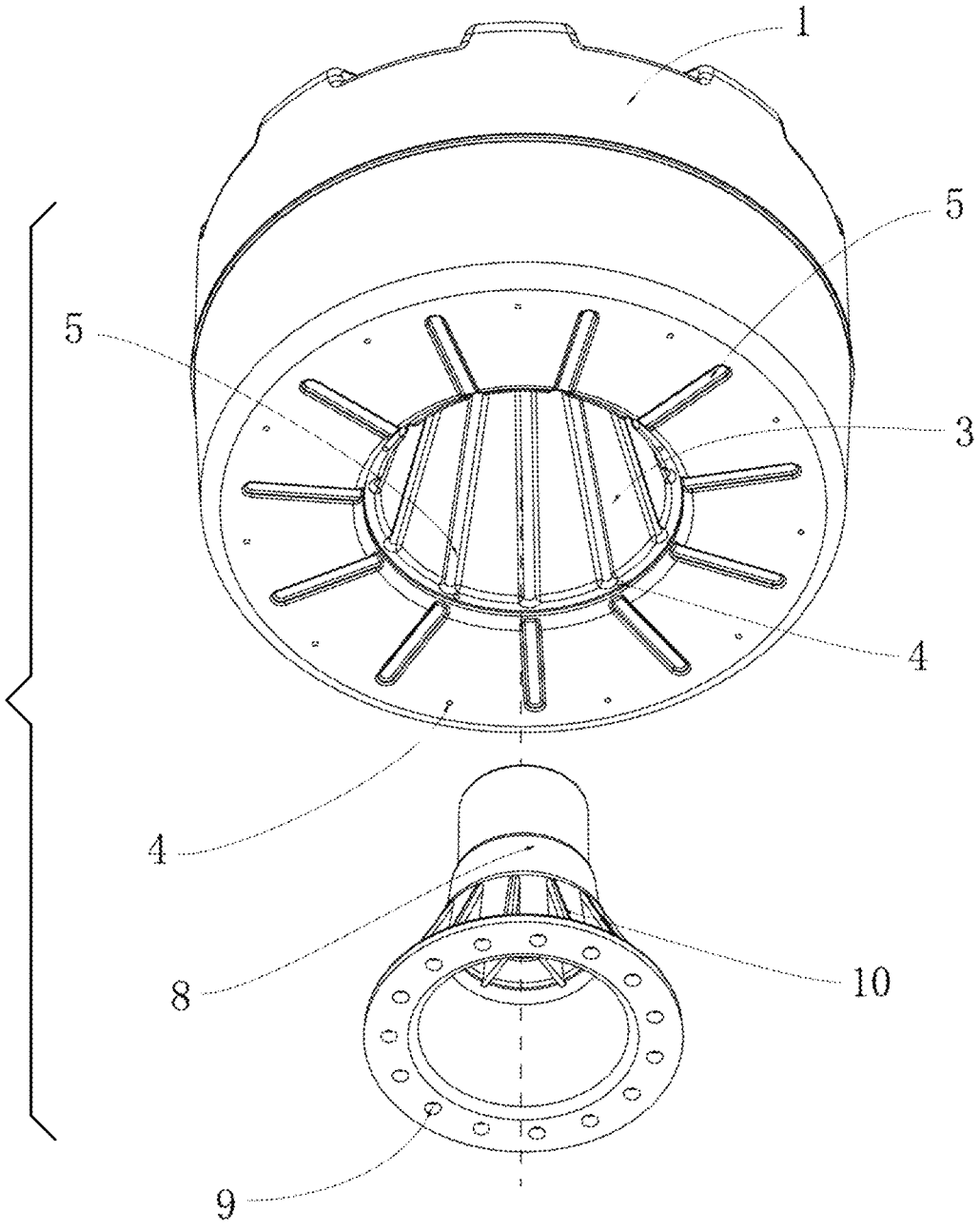
FIG. 2 is a schematic diagram of a counterweight base for a punching bag in a storage state according to one embodiment of the disclosure.
Figure 3:
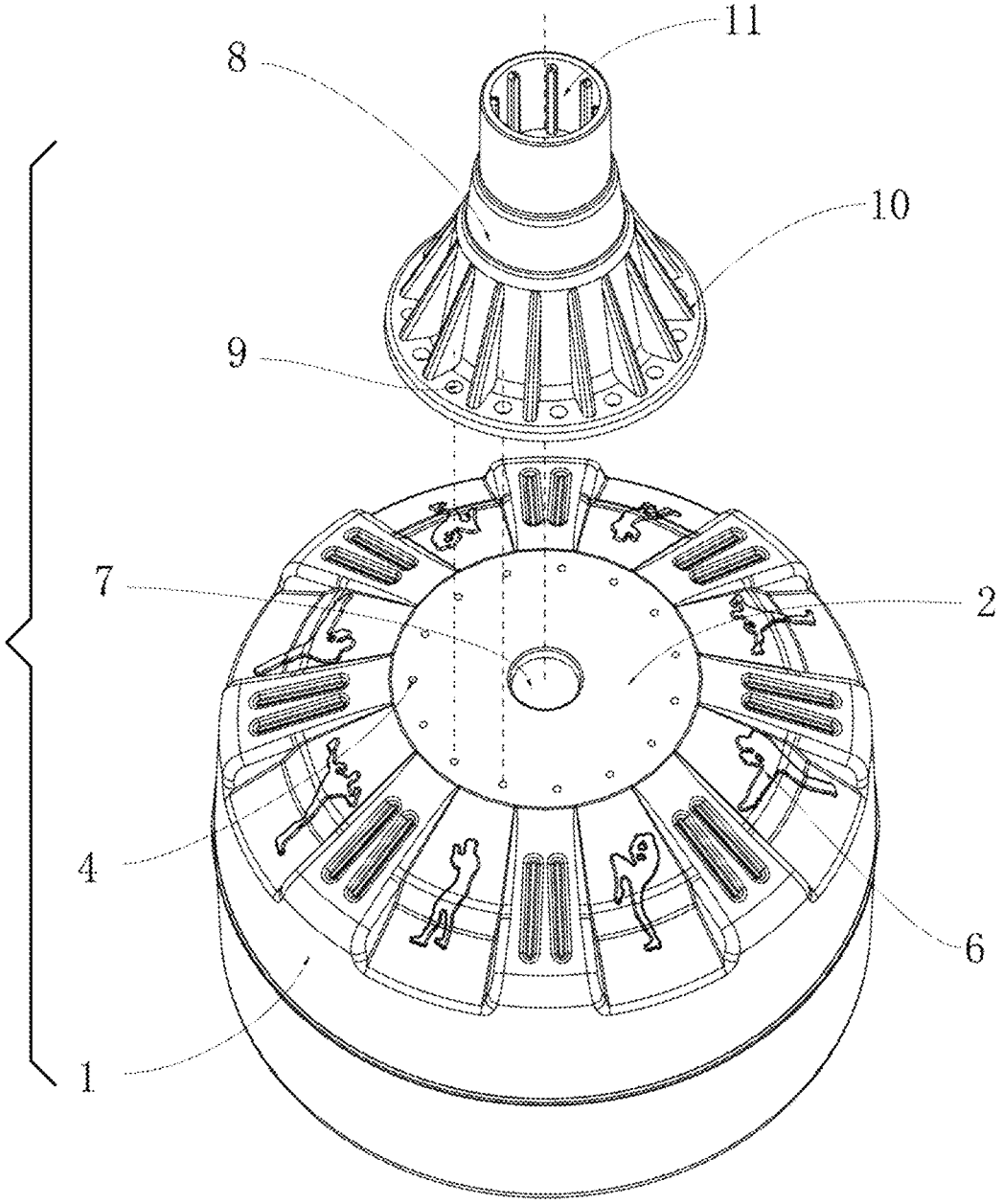
FIG. 3 is a schematic diagram of a counterweight base for a punching bag in a use state according to one embodiment of the disclosure.
Figure 4:
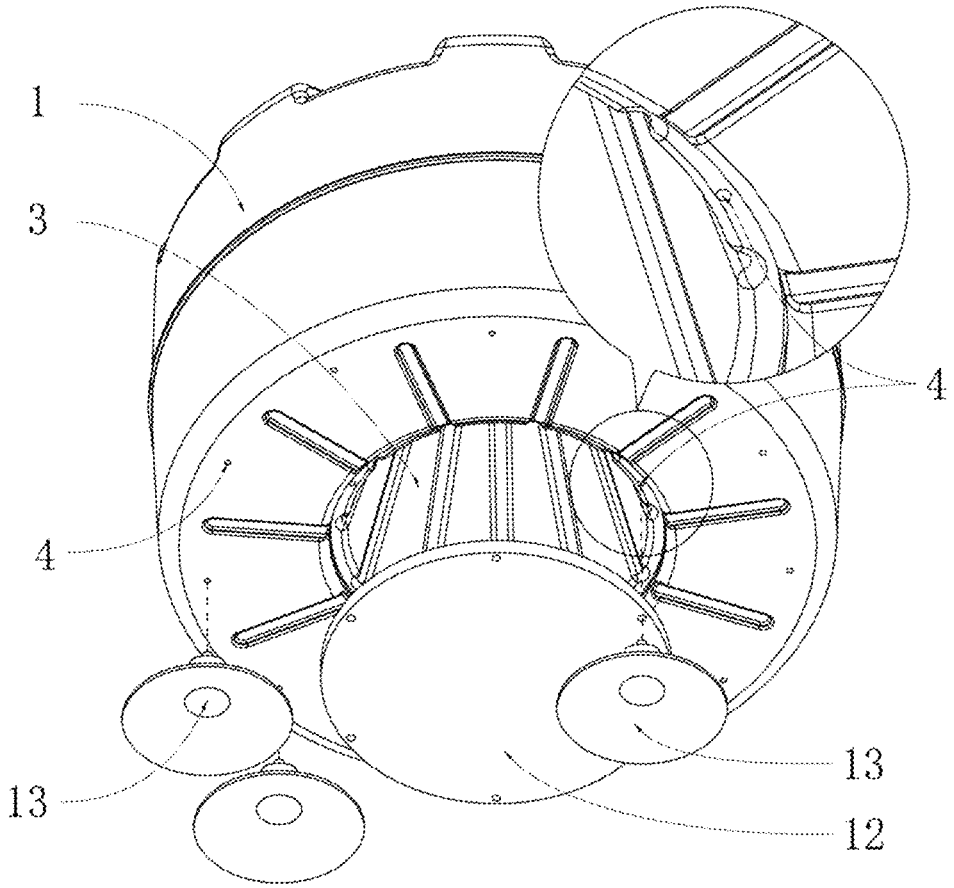
FIG. 4 is an exploded view of a bottom part of a counterweight base for a punching bag according to one embodiment of the disclosure.
Figure 5:
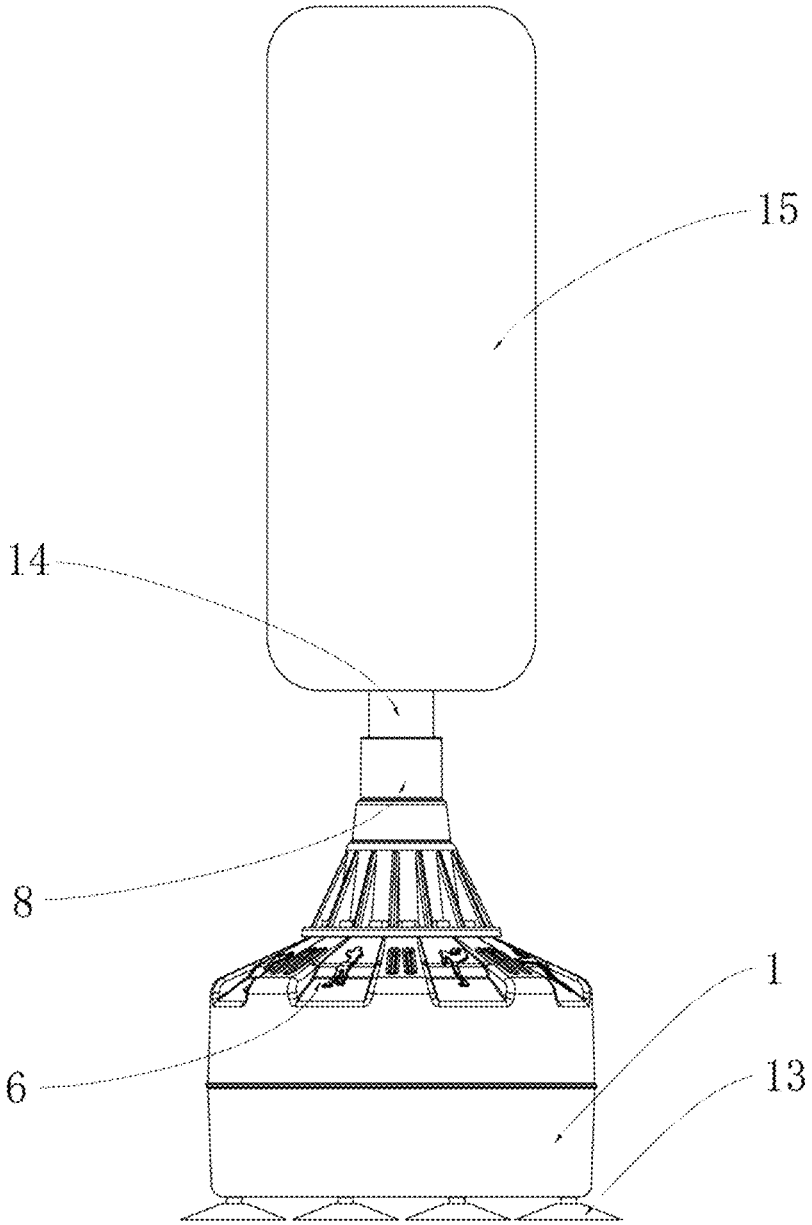
FIG. 5 is a schematic diagram of a counterweight base for a punching bag according to one embodiment of the disclosure.

As shown in FIGS. 1-5, the disclosure provides a counterweight base for a punching bag comprising a counterweight body 1, a conical connector 8, and a plurality of suction discs 13. The counterweight body 1 is a one-piece barrel-shaped container in the form of a flat cylinder, and comprises a platform 2 and an accommodating cavity 3. The upper part of the counterweight body 1 protrudes to form a circular truncated cone, and the platform 2 is disposed in the center of the top surface of the circular truncated cone; the accommodating cavity 3 is disposed in the center of the bottom part of the counterweight body 1. The accommodating cavity 3 comprises a bottom opening that tapers inward, and is in the shape of a conical column. The conical connector 8 is matched with the accommodating cavity 3 in size and shape, and comprises a flange base; a step is disposed in the bottom opening of the accommodating cavity 3; in a storage state of the counterweight base, the conical connector 8 is disposed in the accommodating cavity 3, and the flange base is supported by the step. A plurality of first inbuilt nuts 4 are disposed on the platform 2; the flange base comprises a plurality of mounting holes 9; in a use state of the counterweight base, the conical connector 8 is fixed on the platform 2 through the plurality of first inbuilt nuts 4 passing through the plurality of mounting holes 9. A plurality of second inbuilt nuts are disposed on the bottom end face of the counterweight base 1, and the plurality of suction discs 13 are attached to the counterweight base through the plurality of second inbuilt nuts, respectively, so as to adhere to the smooth ground and provide support and fixation for the counterweight base.

As an improvement, a plurality of radial grooves 5 are disposed on an inner side wall of the counterweight body and the bottom end face of the counterweight body 1; a plurality of strengthening ribs 10 protrude from an outer surface of the conical connector 8; and the plurality of strengthening ribs are embedded in the radial grooves 5 on the inner side wall of the counterweight body, respectively.

As an improvement, a plurality of third inbuilt nuts are disposed on the step; a baffle plate 12 is fixed on the step through the plurality of third inbuilt nuts; a thickness of the baffle plate 12 is equal to a depth of the step, that is, after installation, the baffle plate 12 is on the same plane as the bottom surface of the counterweight base 1. The screws of the suction discs 13 pass through the installation hole of the baffle plate 12 and fixes the baffle plate 12 on the first inbuilt nuts 4, thereby increasing the number of the suction discs and enhancing the stability of the fixation on the ground.

As an improvement, a conical surface of the counterweight body 1 below the platform 2 is a decorative surface 6; and the decorative surface 6 comprises a plurality of evenly distributed patterns with alternating uplifts and sags, which not only beautifies the design of the counterweight base 1, but also enhances the pressure bearing performance thereof.

As an improvement, the counterweight base 1 is an integrated structure formed by plastic injection molding.

As an improvement, the upper part of the counterweight body 1 comprises a top opening 7 and a cover. Water or small particle sand and stones can be filled through the top opening to increase the load and provide stability of the counterweight base. During installation, the accommodating cavity 3 can be filled with sand and stones, and then sealed by the baffle plate 12, thus fully utilizing the counterweight space of the counterweight base.

As an important part of the floor punching bags, the counterweight base 1 is used to stabilize the chassis, and through the connection of the suction discs 13, the floor punching bags can grasp the ground and play a supporting and fixing role, so as to ensure that the practicing body 15 will not sway or move excessively when it is being hit. The counterweight base 1 comprises the accommodating cavity 3, and the conical connector 8 is embedded in the accommodating cavity 3 of the counterweight base 1, which can effectively solve the volume occupation of the conical connector 8, thus effectively reducing the logistics cost without changing the main structure of the product. The counterweight base 1 adopts a container structure, has a light weight, thus reducing the logistics and transportation costs. To further improve the stability of the counterweight base, the filler which can be locally sourced is injected through the top opening 7. The counterweight base is easy to assemble; when in use, the conical connector 8 is fixed on the platform 2, and the practicing body 15 is fixed on the conical connector 8.

During packaging, the conical connector 8 is placed in the accommodating cavity 3 of the counterweight base 1 and packed together with the other components of the punching bag product to complete the packaging.

During assembly, the conical connector 8 is taken out from the accommodating cavity 8 of the counterweight base 1. The cover on the top opening of the counterweight base 1 is removed, and water or sand and gravel with small granularity is filled into the barrel to increase the weight. Thereafter, sand and gravel are filled in the accommodating cavity 3, and the accommodating cavity is sealed by the baffle plate 12, so as to make the utilization of the counterweight space more thorough. If the ground is flat and smooth, it is not necessary to fill the filling material for increasing the weight. Then, the conical connector 8 is installed on the platform 2, and finally, the connecting rod 14 of the practicing body 15 is inserted into the top socket 11 of the conical connector 8.

It will be obvious to those skilled in the art that changes and modifications may be made, and therefore, the aim in the appended claims is to cover all such changes and modifications.

What is claimed is:

1. A counterweight base for a punching bag, comprising a counterweight body, a conical connector, and a plurality of suction discs;

wherein:

the counterweight body is a one-piece barrel-shaped container in the form of a flat cylinder, and comprises a platform and an accommodating cavity;

an upper part of the counterweight body protrudes to form a circular truncated cone, and the platform is disposed in a center of a top surface of the circular truncated cone; the accommodating cavity is disposed in a center of a bottom part of the counterweight body;

the accommodating cavity comprises a bottom opening that tapers inward, and is in the shape of a conical column;

the conical connector is matched with the accommodating cavity in size and shape, and comprises a flange base; a step is disposed in the bottom opening of the accommodating cavity; in a storage state of the counterweight base, the conical connector is disposed in the accommodating cavity, and the flange base is supported by the step;

a plurality of first inbuilt nuts are disposed on the platform; the flange base comprises a plurality of mounting holes; in a use state of the counterweight base, the conical connector is fixed on the platform through the plurality of first inbuilt nuts passing through the plurality of mounting holes; and a plurality of second inbuilt nuts are disposed on a bottom end face of the counterweight base, and the plurality of suction discs are attached to the counterweight base through the plurality of second inbuilt nuts, respectively.

2. The counterweight base for a punching bag of claim 1, wherein a plurality of radial grooves are disposed on an inner side wall of the counterweight body and the bottom end face of the counterweight body; a plurality of strengthening ribs protrude from an outer surface of the conical connector; and the plurality of strengthening ribs are embedded in the radial grooves on the inner side wall of the counterweight body, respectively.

3. The counterweight base for a punching bag of claim 1, wherein a plurality of third inbuilt nuts are disposed on the step; a baffle plate is fixed on the step through the plurality of third inbuilt nuts; the suction discs are further disposed on the baffle plate; and a thickness of the baffle plate is equal to a depth of the step.

4. The counterweight base for a punching bag of claim 1, wherein a conical surface of the counterweight body below the platform is a decorative surface; and the decorative surface comprises a plurality of evenly distributed patterns with alternating uplifts and sags.

5. The counterweight base for a punching bag of claim 1, wherein the counterweight body is an integrated structure formed by plastic injection molding.

6. The counterweight base for a punching bag of claim 1, wherein the upper part of the counterweight body comprises a top opening and a cover.

* * * * *